United States Patent [19]

Zletz

[11] 3,981,811

[45] Sept. 21, 1976

[54] SILICONE FLUIDS AS A CORROSION INHIBITOR FOR PERFLUORINATED POLYETHER FLUIDS

[75] Inventor: Alex Zletz, Naperville, Ill.

[73] Assignee: The United States of America as represented by the Secretary of the Air Force, Washington, D.C.

[22] Filed: Jan. 14, 1976

[21] Appl. No.: 649,105

[52] U.S. Cl. ..... 252/49.6; 252/50; 252/51.5 R; 252/389 R

[51] Int. Cl.[2] ..... C10M 1/10; C10M 1/50; C10M 7/02; C10M 7/48

[58] Field of Search ..... 252/49.6, 50, 51.5 R, 252/389 R

[56] References Cited

UNITED STATES PATENTS

| | | | |
|---|---|---|---|
| 2,779,738 | 1/1957 | McBride | 252/49.6 |
| 3,061,545 | 10/1962 | Badger | 252/49.6 |
| 3,304,259 | 2/1967 | Wright | 252/49.6 |
| 3,518,188 | 6/1970 | Pirson et al. | 252/49.6 |
| 3,575,860 | 4/1971 | Lee et al. | 252/49.6 |

*Primary Examiner*—Delbert E. Gantz
*Assistant Examiner*—I. Vaughn
*Attorney, Agent, or Firm*—Joseph E. Rusz; William J. O'Brien

[57] ABSTRACT

A lubricating grease composition composed of a perfluorocarbon polyether lubricant vehicle and a silicone fluid as a corrosion inhibitor.

4 Claims, No Drawings

SILICONE FLUIDS AS A CORROSION INHIBITOR FOR PERFLUORINATED POLYETHER FLUIDS

STATEMENT OF GOVERNMENT INTEREST

The invention described herein may be manufactured and used by or for the Government for governmental purposes without the payment of any royalty thereon.

BACKGROUND OF THE INVENTION

This invention relates to lubricant greases and to a means for inhibiting their corrosiveness. In a more particular aspect, this invention concerns itself with perfluorinated polyether grease compositions and to the use of silicone fluids for inhibiting their corrosive effects.

In the field of lubrication, especially with the recent utilization of machinery and equipment within the high temperature environments of aerospace operations, it has been suggested the perfluorinated polyether fluids make excellent vehicles for lubricant greases. These fluids, when properly thickened to a grease consistency by conventional thickening agents, exhibit a high degree of thermal stability. This stability renders the greases especially suitable for use in lubricating loaded bearings subject to the degradative effects of high temperature situations. However, perfluorinated polyether greases have not developed their full potential as lubricants for high temperature operations because of their inherent corrosiveness toward ferrous metals. This corrosiveness begins at about 550°F, especially in contact over long periods of time. Previous attempts at overcoming the above problem have produced a number of corrosion inhibitors, but these are not effective over prolonged periods of use.

In accordance with this invention, however, it has been found that the addition of a silicone fluid to a perfluorinated polyether fluid reduces corrosion by the perfluorinated polyether fluid. This corrosion inhibition is exhibited whether the mixture has been thickened to a grease or is used in fluid form. It has also been found that the silicone fluid is effective as a corrosion inhibitor over prolonged periods of use.

SUMMARY OF THE INVENTION

In accordance with the broad concept of this invention, the corrosiveness of perfluorinated polyether fluids and greases which contain a major amount of such fluids as a lubricant vehicle can be inhibited by the addition of a silicone fluid as a corrosion inhibitor. The resulting grease is an especially effective lubricant for loaded ball bearings and other machinery and equipment parts fabricated from ferrous metals.

Accordingly, the primary object of this invention is to provide lubricant greases that exhibit good corrosive protection over prolonged periods of use.

Another object of this invention is to provide a novel corrosion inhibiting agent for perfluorinated polyether fluids and grease.

Still another object of this invention is to provide for the increased use of perfluorinated polyether greases in high temperature applications by inhibiting their inherent corrosiveness against ferrous metals.

The above and still other objects and advantages of this invention will become more readily apparent upon consideration of the following detailed description thereof.

DESCRIPTION OF THE PREFERRED EMBODIMENTS

The present invention is predicated upon the discovery that silicone fluids unexpectedly inhibit the inherent corrosiveness of both perfluorinated polyether fluids and greases in which a perfluorinated polyether fluid is the lubricant vehicle. The perfluorinated polyether fluids are corrosive to ferrous metals. This corrosiveness begins at about 550°F, especially in contact over long periods of time.

Two types of tests were utilized in order to determine the effectiveness of the silicone fluids as corrosion inhibitors for the polyether fluids. Greases were evaluated in a bearing performance test using MRC high temperature test spindles and MRC 204 S-17 bearings at 10,000 rpm with 50 lb. radial and 25 lb. thrust loading. A furnace corrosion test was used to evaluate the fluid alone, although this test can also be used for greases. Two 52100 chrome-steel balls (0.5 inch diameter), one atop the other, were placed in a 5-ml beaker and fluid was added to cover one-half of the lower ball (about 5 mm). Two test samples and a control were placed in the furnace maintained at 600°F with a flow of 0.5 liters per minute of nitrogen. Gas flow had been found to accelerate corrosion regardless of gas composition.

The tests referred to above were all conducted with a perfluorinated polyether fluid identified as Krytox 143AD, a perfluorocarbon polyether fluid from E. I. DuPont de Nemours and Co. In carrying out the bearing performance tests with greases prepared from Krytox 143AD, corrosion debris was often recovered upon dismantling the spindle. In some tests at 550°F of about 400 or more hours or 600°F of about 90 or more hours, this debris caused binding of the spindle making dismantling very difficult. The DuPont corrosion inhibitor M-4 for Krytox fluids helped reduce the formation of this debris but did not eliminate it in the long tests.

The following tables present the test results obtained from the testing procedures referred to above.

TABLE I

BEARING PERFORMANCE OF GREASES

| Test No. | Components, Wt. % Thickener | | M-4 | Kr[a] | F6[b] | Penetration ¼Cone | Bearing Life Hours[c] | Amount of Debris |
|---|---|---|---|---|---|---|---|---|
| 1 | Ekonol | 10.5 | 1.8 | 82.7 | 5.0 | 305 | 578 | Very little |
| 2 | Ekonol | 10.0 | 1.7 | 78.3 | 10.0 | 324 | 140 | Some |
| 3 | Ekonol | 9.9 | 1.8 | 78.3 | 6.7 | 304 | 460 | Very little |
| | and | | | | | | | |
| | Ammeline[d] | 3.3 | | | | | | |
| 4 | Nitropolyphenylene | 5.4 | — | 90.8 | 3.8 | 302 | 177 | Very little |

TABLE I-continued

| Test No. | BEARING PERFORMANCE OF GREASES Components, Wt. % Thickener | M-4 | Kr[a] | F6[b] | Penetration ¼Cone | Bearing Life Hours[c] | Amount of Debris |
|---|---|---|---|---|---|---|---|
| 5 | Aminopolyphenylene | 11.6 | 2.4 | 81.0 | 5.0 | 230 | 261 | Some powder |

[a]Kr - Krytox 143AD fluid
[b]F6 - F6-7039 fluid
[c]Run at 550°F
[d]Ekonol and Ammeline are p-oxybenzoyl polymer and 2,4-diamino-6-hydroxy-1,3,5-triazine, respectively, and are conventional thickening agents for perfluorinated polyether fluids

TABLE II

| Test No. | Additive in Krytox 143AD, Wt. % | | FURNACE CORROSION TEST Appearance Top Ball | Bottom Ball |
|---|---|---|---|---|
| 1 | Empty beaker. | | Smooth, Blue | Smooth, Blue |
| 2 | Krytox 143AD, | 100 | Blue, pitted in area near lower ball. | Thick hard crust on lower ⅔, top pitted. |
| 3 | F6-7039, | 100 | Smooth, Blue | Smooth, Dark Blue |
| 4 | F6-7039, | 10 | Smooth, Blue | Smooth all over; top dark blue, part in liquid is deep purple. |
| 5 | F6-7039, | 3 | Smooth, Blue | Smooth all over except for small transparent deposit at point of contact with glass and air. |
| 6 | F6-7039, | 1 | Smooth, Blue | Smooth on top ⅓; very light roughness on lower ⅔. |
| 7 | XF-1085, | 10 | Smooth, Blue | Smooth all over, deep purple at air-glass-fluid-ball surface and brown on other parts. |
| 8 | DC-550, | 10 | Smooth, Blue-Gray | Smooth all over except for deposit at air-glass-fluid-ball zone. |
| 9 | DC-560, | 10 | Smooth, top part light blue, lower part blue-gray. | Smooth, brown on top, rough, brown on lower part. |
| 10 | FS-1265, | 10 | Top part smooth, blue; lower part purple and slightly pitted. | Smooth, blue on top, bottom is rough and pitted. |
| 11 | M-4, | 3 | Top ⅓ blue and smooth. Brown pit where balls touched, black pitted area on one side of lower ⅔, rest white. | Pit where balls touched. Bottom and side in contact with glass is corroded. Surface is rough with some black corrosion spots. Black matter in liquid. |

In Table I, the test results show the effect of Dow-Corning Co. high-phenyl methylphenyl silicone fluid, F6-7039, in greases from Krytox 143AD on the formation of debris. In Test 1 a long life of 578 hours was obtained yet very little debris was present. In Test 2 with twice the amount of F6-7039, a brief life of 140 hours resulted in more debris than in Test 1. This suggests there is an optimum concentration of silicone for greatest effectiveness. A combination of two thickeners was used in the grease of Test 3. Very low debris was obtained despite the long test. In Tests 4 and 5 substituted polyphenylenes, which are not conventional thickeners, were found to be effective thickeners.

In the furnace corrosion test of Table II, Test 1 shows the effect when no fluid is present. A characteristic color due to the temperature is obtained. Test 2 shows that Krytox 143AD alone results in some corrosion of the top ball and that the lower ball has developed a thick hard crust over most of the surface. Test 3 shows that F6-7039 fluid alone gives nearly the same result as when no fluid is present in the beaker. In Test 4, 10% F6-7039 in Krytox gave smooth top and bottom balls. In Test 5, 3% F6-7039 gave smooth balls except for a thin transparent deposit over a very small area. In Test 6, 1% F6-7039 resulted in a very light roughening of the ball exposed to fluid but this small amount of silicone eliminated the formation of the heavy crust. In Test 7, XF-1085 fluid, a high-phenyl methylphenyl-silicone from General Electric Co., gave results similar to F6-7039 in Test 4. In Test 8, 10% DC-550, a low-phenyl methylphenylsilicone fluid from the Dow Corning Corporation resulted in some deposit formed at the fluid-ball-air-glass interface, but the ball was smooth elsewhere. This deposit may have consisted of solidified silicone. In Test 9, with 10% DC-560, a chlorophenylmethyl silicone fluid from Dow Corning, the ball exposed to the fluid had a roughened surface and was discolored, yet the heavy deposit arising from Krytox was not present. In Test 10, 10% FS-1265, a methyltrifluoropropyl silicone fluid, the lower position of the top ball had slight pitting and the bottom ball was attached on the portion exposed to fluid. In Test 11, with 3% M-4 the top and bottom balls had corrosion spots where both balls contacted. The top ball had a black pitted area on lower part of the ball. The lower ball was pitted all over with some black areas.

It is apparent from the furnace corrosion tests that the methylphenyl silicone fluids protect the iron-containing metal balls from attack by the fluorinated polyether fluids and that the high-phenyl containing fluids are the best. Furthermore, even 1% F6-7039 is better than 3% M-4 as a corrosion inhibitor.

While this invention has been described with reference to various embodiments, it should be understood that the description is presented as illustrative only, and the invention includes within its scope such modifications and alterations as come within the spirit of the appended claims.

What is claimed is:

1. A lubricating composition comprising (1) a major amount of a perfluorocarbon polyether fluid and (2) a minor corrosion inhibiting amount of a silicone fluid selected from the group consisting of methylphenyl silicone, chlorophenylmethyl silicone, and methyltrifluoropropyl silicone.

2. The lubricating composition of claim 1 wherein the polyether fluid is thickened to a grease consistency with at least one thickening agent selected from the group consisting of p-oxybenzoyl polymer and 2,4-diamino-6-hydroxy-1,3,5-triazine.

3. A composition in accordance with claim 1 wherein said silicone fluid is a methylphenyl silicone.

4. A composition in accordance with claim 1 wherein said silicone fluid is present in an amount of from about one to about ten percent by weight of said composition.

* * * * *